US011598202B2

(12) United States Patent
Sedano

(10) Patent No.: US 11,598,202 B2
(45) Date of Patent: Mar. 7, 2023

(54) COMMUNICATIONS USING ELECTRICAL PULSE POWER DISCHARGES DURING PULSE POWER DRILLING OPERATIONS

(71) Applicant: Halliburton Energy Services, Inc., Houston, TX (US)

(72) Inventor: Jesus Jason Sedano, Salinas, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/133,147

(22) Filed: Dec. 23, 2020

(65) Prior Publication Data

US 2022/0195866 A1 Jun. 23, 2022

(51) Int. Cl.

| | |
|---|---|
| ***E21B 47/13*** | (2012.01) |
| ***E21B 7/15*** | (2006.01) |
| ***E21B 47/18*** | (2012.01) |
| ***E21B 44/00*** | (2006.01) |
| ***E21B 47/125*** | (2012.01) |

(52) U.S. Cl.

CPC ..... *E21B 47/13* (2020.05); *E21B 7/15* (2013.01); *E21B 44/00* (2013.01); *E21B 47/125* (2020.05); *E21B 47/18* (2013.01)

(58) Field of Classification Search

CPC ..... E21B 47/13; E21B 47/125; E21B 47/18; E21B 7/15

See application file for complete search history.

(56) References Cited

U.S. PATENT DOCUMENTS

| | | | |
|---|---|---|---|
| 2009/0133929 | A1 | 5/2009 | Rodland |
| 2010/0065329 | A1 | 3/2010 | Zientarski |
| 2019/0353031 | A1 | 11/2019 | Logan et al. |

FOREIGN PATENT DOCUMENTS

| | | | |
|---|---|---|---|
| CN | 104047590 | A | 9/2014 |
| WO | 2015124733 | A2 | 8/2015 |

OTHER PUBLICATIONS

PCT Application No. PCT/US2020/067030; International Search Report; dated Sep. 8, 2021, 3 pages.

PCT Application No. PCT/US2020/067030; Written Opinion; dated Sep. 8, 2021, 5 pages.

*Primary Examiner* — Kristyn A Hall

(74) *Attorney, Agent, or Firm* — Delizio, Peacock, Lewin & Guerra

(57) ABSTRACT

A pulse power drilling system includes a pulse power drill string to be positioned in a borehole formed in a subsurface formation. The pulse power drill string is to drill the borehole based on periodic pulsing of an electrical discharge into the subsurface formation. The pulse power drill string includes a generator to generate electrical power, an electrode to emit the electrical discharge out to the subsurface formation based on the electrical power, and a controller communicatively coupled to the generator and the electrode. The controller is to control at least one discharge parameter of the electrical discharge to encode a data communication within the electrical discharge.

20 Claims, 7 Drawing Sheets

COMMUNICATIONS USING ELECTRICAL PULSE POWER DISCHARGES DURING PULSE POWER DRILLING OPERATIONS

TECHNICAL FIELD

The disclosure generally relates to communications and more particularly to communications using electrical pulse power discharges during pulse power drilling operations.

BACKGROUND

During pulse power drilling, electrical power can be generated and transmitted along the pulse power drill string to be used for periodic pulsing of electrical discharges as part of the drilling. The amount of such electrical power can be extremely high. Such electrical power can inhibit communications from components of a pulse power drill string that are downhole. In particular, such power levels can result in fluctuations in electric fields and mechanical oscillations. Also, pulse power drilling operations can cause vibrations that further complicate electrical, mechanical, and optical signal transmission of data from downhole. Drill string components for pulse power drilling can also experience stress at joints and junctions between components, which can weaken communication and mechanical links between portions of the drill string.

BRIEF DESCRIPTION OF THE DRAWINGS

Embodiments of the disclosure may be better understood by referencing the accompanying drawings.

DESCRIPTION OF EMBODIMENTS

Figure 1:
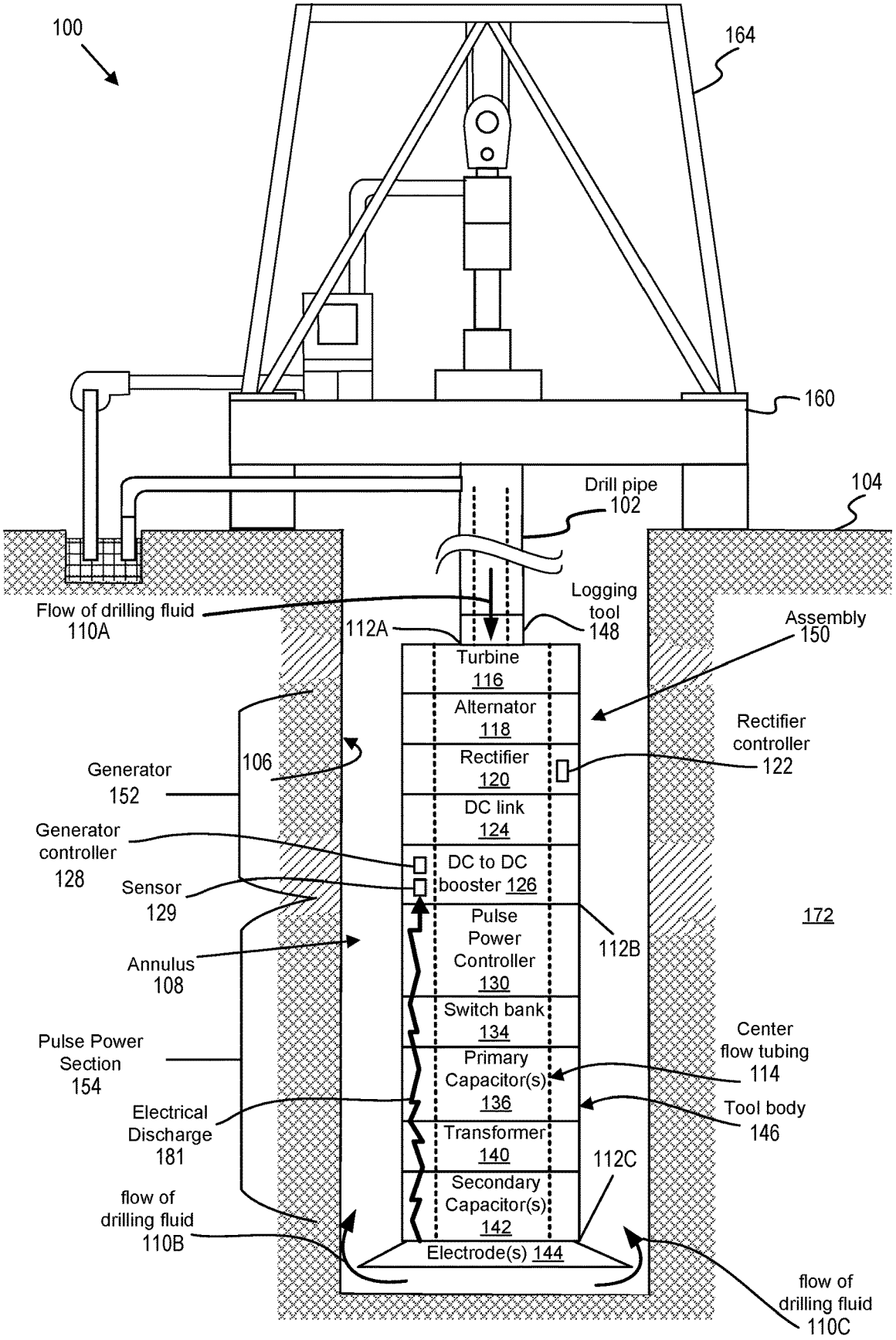
FIG. 1 depicts a first example pulse power drilling assembly that includes communications using electrical pulse power discharges, according to some embodiments.

The description that follows includes example systems, methods, techniques, and program flows that embody embodiments of the disclosure. However, it is understood that this disclosure may be practiced without these specific details. For instance, this disclosure refers to sensors at example locations for detecting communications via the electrical discharge during pulse power operations. However, such sensors can be located at other locations. For example, sensors can be positioned at any location along the drill string and at other locations in the borehole or at the surface. In other instances, well-known instruction instances, protocols, structures, and techniques have not been shown in detail in order not to obfuscate the description.

Electrical discharges generated during pulse power drilling operations can require a large amount of power to effectively drill. Such power downhole can render some conventional communications (e.g., electrical) inefficient or inoperable. Some conventional communications can be compatible with pulse power drilling, including, for example, pressure pulse or acoustic telemetry. However, the rate of transmission for such communications can be low, even when multiple types of communications are used in combination. A low data communication rate can lead to only a portion of data collected downhole being transmitted from downhole. In order to obtain all of the data collected downhole, the collected data can be stored in machine-readable media positioned in the pulse power drilling assembly. Such data can then be downloaded when the assembly is brought to the surface. Storing the collected data downhole can be limited by the size of the machine-readable media positioned in the assembly and how much time until the assembly returns to the surface. This can lead to the data being retained and/or compressed based on a selective criterion to manage data loss. For example, the collected data can be reduced to a sub-set of data by selecting to retain only data that is necessary for accomplishing a known or desired operation using commands and controls that are already part of the pulse power drilling. However, selectively retaining only a sub-set of the total data collected downhole can result in the loss of valuable information. Because recent advancements in machine-learning and artificial intelligence can enable the processing of large amounts of data to increase the efficiency of drilling operations, it is beneficial to retain as much data as possible. Further, retaining as much of the collected data as possible can maximize the value and capability of investments made in the development and procurement of complex and sophisticated sensor arrays found along a drillstring.

In example embodiments, the periodic electrical discharge that is generated for the drilling during pulse power operations can be also be used for communications. In particular, pulse power drilling can be based on periodic electrical discharges from electrodes that cause formation destruction due to plasma formation, liquid vaporization, gas expansion from temperature changes, vibration, and shockwave effects, etc. In some implementations, at least one discharge parameter for generating the periodic electrical discharge can be the basis for communication. For example, the rate and timing of discharging or 'pulsing' can be the communication. To illustrate, the time between pulses can used for communication. For binary communication, if the time between pulses is within a first range, the communication is zero. If the time between pulses is within a second range, the communication is one. In some embodiments, varying lengths of time of electrical pulses themselves can be used for communication. For binary communication, if the time of a pulse is within a first range, the communication is zero. If the time of a pulse is within a second range, the communication is one. Other characteristics of the discharge can be modulated to provide for additional layers of communication. For example, the frequency, phase, and/or amplitude of the pulse discharge can be adjusted.

A pulse power drilling assembly can include a pulse power controller for controlling periodic emission of electrical discharges into a subsurface formation through one or more electrodes of the assembly. The pulse power controller can modulate pulses to generate modulated electrical discharges from the electrodes based on data collected by downhole sensors. For example, the pulse power controller can embed sensor data in electrical discharges by varying a time delay between pulses. In some embodiments, the pulse power controller can modulate an acoustic signal derived from the electrical discharges based on the sensor data. The acoustic signal can be modulated to transmit data communications uphole by adjusting a phase, frequency, amplitude, time delay, etc. of the electrical discharges. In some implementations, the pulse power controller can modulate pulses to induce thermodynamic expansion of a borehole fluid for detection uphole as a means for transmitting information. For example, the pulse power controller can modulate pulses to induce thermodynamic expansion of a drilling fluid to transmit a signal to be detected uphole as a change in fluid pressure.

A sensor (receiver) can receive and detect the electrical discharges. Such sensors can be at different locations to detect the electrical discharges. For example, a sensor can be at a location on the drill string, at a surface of the borehole, in a different borehole, etc. As an example, the sensor can be positioned above a joint of the drill string to enable transmission of communication above such a joint that can be problematic using conventional communications. There can be multiple type of sensors to capture different aspects of the electrical discharge. For example, an electrical sensor can detect an electrical attribute (such as phase, frequency, amplitude, etc.) of the electrical discharge. In another example, an acoustic sensor can detect an acoustic attribute of the electrical discharge. A processor can receive the detected data from the sensors and decode any communication therein.

Modulating discharges in pulse power drilling operations as a means for information transmission can result in cost savings. For example, a modulating pulse power tool can eliminate the need for additional downhole communication systems, circuitry, and power intensive and complex transmitter circuits. With a decreased number of power intensive communication components, a modulating pulse power tool can operate for an extended run time. Additionally, costs for maintenance and repairs can be lower if a standard wired communication (that tend to break or be unreliable in a downhole environment) are not used. Further, a modulating pulse power tool can be included in addition to existing telemetry systems of a pulse power system to provide additional telemetry bandwidth uphole.

Example Drilling Systems

FIG. 1 depicts a first example pulse power drilling assembly that includes communications using electrical pulse power discharges, according to some embodiments. FIG. 1 illustrates an example pulse power drilling apparatus 100.

The example pulse power drilling apparatus 100 can include a pulse power drilling assembly (hereinafter "assembly") 150 positioned in a borehole 106 and secured to a length of drill pipe 102 coupled to a drilling platform 160 and a derrick 164. The assembly 150 can be configured to further the advancement of the borehole 106 using pulse electrical power generated by the assembly 150 and provided to electrodes 144 in a controlled manner to break up or crush formation material of a subsurface formation 172 along the bottom face of the borehole 106 and in the nearby proximity to the electrodes 144.

A flow of drilling fluid (illustrated by the arrow 110A pointing downward within the drill pipe 102) can be provided from the drilling platform 160, and flow to and through a turbine 116, exiting the turbine 116 and flowing on into other sub-sections or components of the assembly 150, as indicated by the arrow 110B. The flow of drilling fluid through the turbine 116 can cause the turbine 116 to be mechanically rotated. This mechanical rotation can be coupled to an alternator sub-section or component of the assembly (hereinafter "alternator") 118 in order to generate electrical power. The alternator 118 can further process and controllably provide the electrical power to the rest of the downstream assembly 150. The stored power can then be output from the electrodes 144 in order to perform the advancement of the borehole 106 via periodic electrical discharges.

The drilling fluid can flow through the assembly 150, as indicated by arrow 110B, and flow out and away from the electrodes 144 and back toward the surface to aid in the removal of the debris generated by the breaking up of the formation material at and nearby the electrodes 144. The fluid flow direction away from the electrodes 144 is indicated by arrows 110 C and 110 D. In addition, the flow of drilling fluid may provide cooling to one or more devices and to one or more portions of the assembly 150. In various embodiments, it is not necessary for the assembly 150 to be rotated as part of the drilling process, but some degree of rotation or oscillations of the assembly 150 may be provided in various embodiments of drilling processes utilizing the assembly 150, including internal rotations occurring at the turbine 116, in the alternator sub-section, etc.

As illustrated in FIG. 1, the assembly 150 includes multiple sub-assemblies, including in some embodiments the turbine 116 at a top of the assembly 150 where the top of the assembly is a face of the assembly 150 furthest from a drilling face of the assembly 150 (which contains the electrodes 144). The turbine 116 can be coupled to multiple additional sub-sections or components. These additional sub-sections or components may include various combinations of the alternator 118, a rectifier 120, a rectifier controller 122, a direct current (DC) link 124, a DC to DC booster 126, a generator controller 128, a sensor 129, a pulse power controller 130, a switch bank 134, including one or more switches 138, one or more primary capacitor(s) 136, a transformer 140, one or more secondary capacitors 142, and the electrodes 144.

The assembly 150 can be divided into a generator 152 and a pulse power section 154. The generator 152 can include the turbine 116, the alternator 118, the rectifier 120, the rectifier controller 122, the DC link 124, the DC to DC booster 126, the generator controller 128 and the sensor 129. The pulse power section 154 can include the pulse power controller 130, the switch bank 134, the one or more primary capacitor(s) 136, the transformer 140, the one or more secondary capacitors 142, and the electrodes 144. Components can be divided between the generator 152 and the pulse power section 154 in other arrangements, and the order of the components can be other than shown. The assembly 150 may be comprised of multiple sub-sections, with a joint used to couple each of these sub-sections together in a desired arrangement to form the assembly 150. Field joints 112A-C can be used to couple the generator 152 and the pulse power section 154 to construct the assembly 150 and to couple the assembly 150 to the drill pipe 102. Embodiments of the assembly 150 may include one or more additional field joints coupling various components of the assembly 150 together. Field joints may be places where the assembly 150 is assembled or disassembled in the field, for example at the drill site. In addition, the assembly 150 may require one or more joints referred to as shop joints that are configured to allow various sub-sections of the assembly 150 to be coupled together (for example at an assembly plant or at a factory). For example, various components of the assembly 150 may be provided by different manufacturers, or assembled at different locations, which require assembly before being shipped to the field.

Regardless of whether a joint in the assembly 150 is referred to as a field joint or a shop joint, the center flow tubing 114 can extend through any of the components that includes the center flow tubing 114. A joint between separate sections of the center flow tubing 114 or a hydraulic seal capable of sealing the flow of the drilling fluid within the center flow tubing 114 may be formed to prevent leaking at the joints.

The flow of drilling fluid passing through the turbine 116 can continue to flow through one or more sections of a center flow tubing 114, which thereby provides a flow path for the drilling fluid through one or more sub-sections or components of the assembly 150 positioned between the turbine 116 and the electrodes 144, as indicated by the arrow 110B pointing downward through the cavity of the sections of the center flow tubing 114. Once arriving at the electrodes 144, the flow of drilling fluid can be expelled out from one or more ports or nozzles located in or in proximity to the electrodes 144. After being expelled from the assembly 150, the drilling fluid can flow back upward toward the surface through an annulus 108 created between the assembly 150 and walls of the borehole 106.

The center flow tubing 114 may be located along a central longitudinal axis of the assembly 150 and may have an overall outside diameter or outer shaped surface that is smaller in cross-section than the inside surface of a tool body 146 in cross-section. As such, one or more spaces can be created between the center flow tubing 114 and an inside wall of the tool body 146. These one or more spaces may be used to house various components, such as components which make up the alternator 118, the rectifier 120, the rectifier controller 122, the DC link 124, the DC to DC booster 126, the generator controller 128, the sensor 129, the pulse power controller 130, the switch bank 134, the one or more switches 138, the one or more primary capacitor(s) 136, the transformer 140, and the one or more secondary capacitors 142, as shown in FIG. 1. Other components may be included in the spaces created between the center flow tubing 114 and the inside wall of the tool body 146.

The center flow tubing 114 can seal the flow of drilling fluid within the hollow passageways included within the center flow tubing 114 and at each joint coupling sections of the center flow tubing 114 together to prevent the drilling fluid from leaking into or otherwise gaining access to these spaces between the center flow tubing 114 and the inside wall of the tool body 146. Leakage of the drilling fluid outside the center flow tubing 114 and within the assembly 150 may cause damage to the electrical components or other devices located in these spaces and/or may contaminate fluids, such as lubrication oils, contained within these spaces, which may impair or completely impede the operation of the assembly 150 with respect to drilling operations.

The example pulse power drilling apparatus 100 can include one or more logging tools 148. The logging tools 148 are shown as being located on the drill pipe 102, above the assembly 150, but can also be included within the assembly 150 or joined via shop joint of field joint to assembly 150. The logging tools 148 can include one or more logging with drilling (LWD) or measurement while drilling (MWD) tool, including resistivity, gamma-ray, nuclear magnetic resonance (NMR), etc. The logging tools 148 can include one or more sensors to collect data downhole. For example, the logging tools 148 can include pressure sensors, flowmeters, etc. The example pulse power drilling apparatus 100 can also include directional control, such as for geosteering or directional drilling, which can be part of the assembly 150, the logging tools 148, or located elsewhere on the drill pipe 102.

Communication from the pulse power controller 130 to the generator controller 128 allows the pulse power controller 130 to transmit data about and modifications for pulse power drilling to the generator 152. Similar, communication from the generator controller 128 to pulse power controller 130 allows the generator 152 to transmit data about and modifications for pulse power drilling to the pulse power section. The pulse power controller 130 can control the discharge of the pulse power stored for emissions out from the electrodes 144 and into the formation 172, into drilling mud, or into a combination of formation and drilling fluids. The pulse power controller 130 can measure data about the electrical characteristics of each of the electrical discharges-such as power, current, and voltage emitted by the electrodes 144. Based on information measured for each discharge, the pulse power controller 130 can determine information about drilling and about the electrodes 144, including whether or not the electrodes 144 are firing into the formation 172 (i.e. drilling) or firing into the formation fluid (i.e. electrodes 144 are off bottom). The generator 152 can control the charge rate and charge voltage for each of the multiple pulse power electrical discharges. The generator 152, together with the turbine 116 and alternator 118, can create an electrical charge in the range of 16 kilovolts (kV) which the pulse power controller 130 delivers to the formation 172 via the electrodes 144.

When the pulse power controller 130 can communicate with the generator 152, the generator 152 and the alternator 118 can ramp up and ramp down in response to changes or electrical discharge characteristics detected at the pulse power controller 130. Because the load on the turbine 116, the alternator 118, and the generator 152 is large (due to the high voltage), ramping up and ramping down in response to the needs of the pulse power controller 130 can protect the generator 152 and associated components from load stress and can extend the lifetime of components of the pulse power drilling assembly. If the pulse power controller 130 cannot communicate with the generator 152, then the generator 152 may apply a constant charge rate and charge voltage to the electrodes 144 or otherwise respond slowly to downhole changes—which would be the case if the generator 152 is controlled by the drilling mud flow rate adjusted at the surface or another surface control mechanism.

In instances where the assembly 150 is off bottom, electrical power input to the system can be absorbed (at least partially) by the drilling fluid, which can be vaporized, boiled off, or destroyed because of the large power load transmitted in the electrical pulses. In instances where the assembly 150 is not operating correctly, such as when one or more switch experiences a fault or requires a reset, application of high power to the capacitors 136/142 or the electrodes 144 can damage circuitry and switches when applied at unexpected or incorrect times. In these and additional cases, communications or messages between the pulse power controller 130 and the generator 152 allow the entire assembly to vary charge rates and voltages. Especially where the pulse power controller 130 and generator 152 are autonomous, i.e., not readily in communication with the surface, downhole control of the assembly 150 can improve pulse power drilling function.

The pulse power controller 130 can control pulsing of electrical discharges from the electrodes 144 to encode a data communication within the electrical discharges to be received by one or more sensors at other locations. For example, the data communication can be electrical and/or acoustic data communication. To illustrate, the sensors can be positioned at different locations in the borehole (e.g., along the assembly 150, at the surface of the borehole, in another borehole, etc.). For the example of FIG. 1, the sensor to detect the electrical discharges includes the sensor 129 such that the casing of the assembly 150 can be the transmission medium through which an electrical discharge 181 propagates. Another example location can be a sensor in the logging tool 148.

Examples of data communications that can be encoded in the electrical discharges can be control signals to modify subsequent pulse power drilling operations, formation evaluation data from other sensors, etc. For example, the pulse power controller 130 can control the discharge of the pulse power stored for emissions out from the electrodes 144 and into the formation 172, into drilling mud, or into a combination of formation and drilling fluids. In some embodiments, data communications can include instructions to modify one or more generator parameters. Generator parameters can include charge rates and voltages for components of the assembly 150. For example, a generator parameter can define a charge rate for charging the primary capacitors 136.

Downhole sensors located along the tool body 146 can measure data. Based on sensor data, the pulse power controller 130 can determine information to communicate uphole and embed an electric data communication in electrical discharges by modulating a characteristic of the pulsing. The pulse power controller 130 can transmit communications uphole by modulating the pulsing according to one or more discharge parameters which, when decoded uphole, can represent the sensor data. For example, the pulse power controller 130 can modulate the electrical discharges 181 by adjusting one or more of a time delay between sequential discharges, a frequency of a discharge, an amplitude of a discharge, a phase of a discharge, etc.

While described in reference to detection of electrical attributes of an electrical discharge, some embodiments can detect other attributes. For example, in some embodiments, information can be transmitted uphole through an acoustic signal generated by blasting the formation with an electric discharge.

The acoustic signal can be modulated to transmit information as an acoustic transmission by adjusting the discharge parameters for an electrical discharge. For example, a frequency of the acoustic signal can be adjusted by adjusting a discharge parameter defining a frequency for pulsing of electrical discharges. Similar to the electrical discharge 181 propagating along the tool body 146, the acoustic signal can also propagate along the tool body 146 to be detected by an acoustic receiver uphole of the electrodes 144. For example, the electrical discharge 181 can vibrate the tool body 146 and the sensor 129 can detect vibrations in the tool body 146. A processor coupled to the sensor 129 can decode a detected electrical discharge and/or acoustic signal to obtain information encoded in the discharge or signal. In some embodiments, the electrical discharge and/or acoustic signal can include encoded instructions to adjust an aspect of the pulse power drilling operation. For example, the sensor 129 can detect an electrical discharge containing encoded instructions to adjust an amount of power to store in the capacitors 136 and/or 142 and charge the capacitors 136, 142 accordingly.

Discharge parameters can include a frequency, an amplitude, a phase shift, a discharge duration, a time delay between discharges of a sequence of discharges, etc. For example, data from pressure sensors can be transmuted into a time delay between sequential discharges. In some embodiments, data from multiple types of sensors can be transmuted into distinct discharge parameters that can be layered to transmit multiple types of information in a single discharge or a series of discharges. For example, in addition to transmuting pressure sensor data into a time delay between discharges, temperature data can be transmuted into an amplitude for the discharges. In some implementations, a speed of the drilling operation may be slightly decreased to increase a data communication rate or a signal-to-noise ratio. For example, it may be beneficial to increase a time delay between sequential discharges if there is a low signal-to-noise ratio at short time delays.

In some implementations, it may be beneficial to stop the drilling operation to transmit large amounts of data uphole. Drilling can be stopped and a fluid specially designed for data transmittal can flow along the path of the drilling fluid, as illustrated by the arrows 110A and 110B, to flood the annulus 108 of the borehole 106. The borehole 106 can be flooded with the specially designed fluid to increase the data communication rate and/or increase the signal-to-noise ratio. The fluid can be designed to carry an electrical discharge from the electrodes 144 and/or an acoustic signal generated by the electrical discharge uphole. For example, the annulus 108 can be flooded with a water-based drilling mud and the electrical discharge can be detected uphole at the logging tool 148 using resistivity measurements. In some embodiments, the drilling fluid can be designed to allow for data transmittance. For example, a drilling dielectric fluid that is designed to have a compressibility that can enable propagation of an acoustic signal through the dielectric fluid can be used to flood the annulus 108 to allow for transmittance of the acoustic signal uphole.

Figure 2:
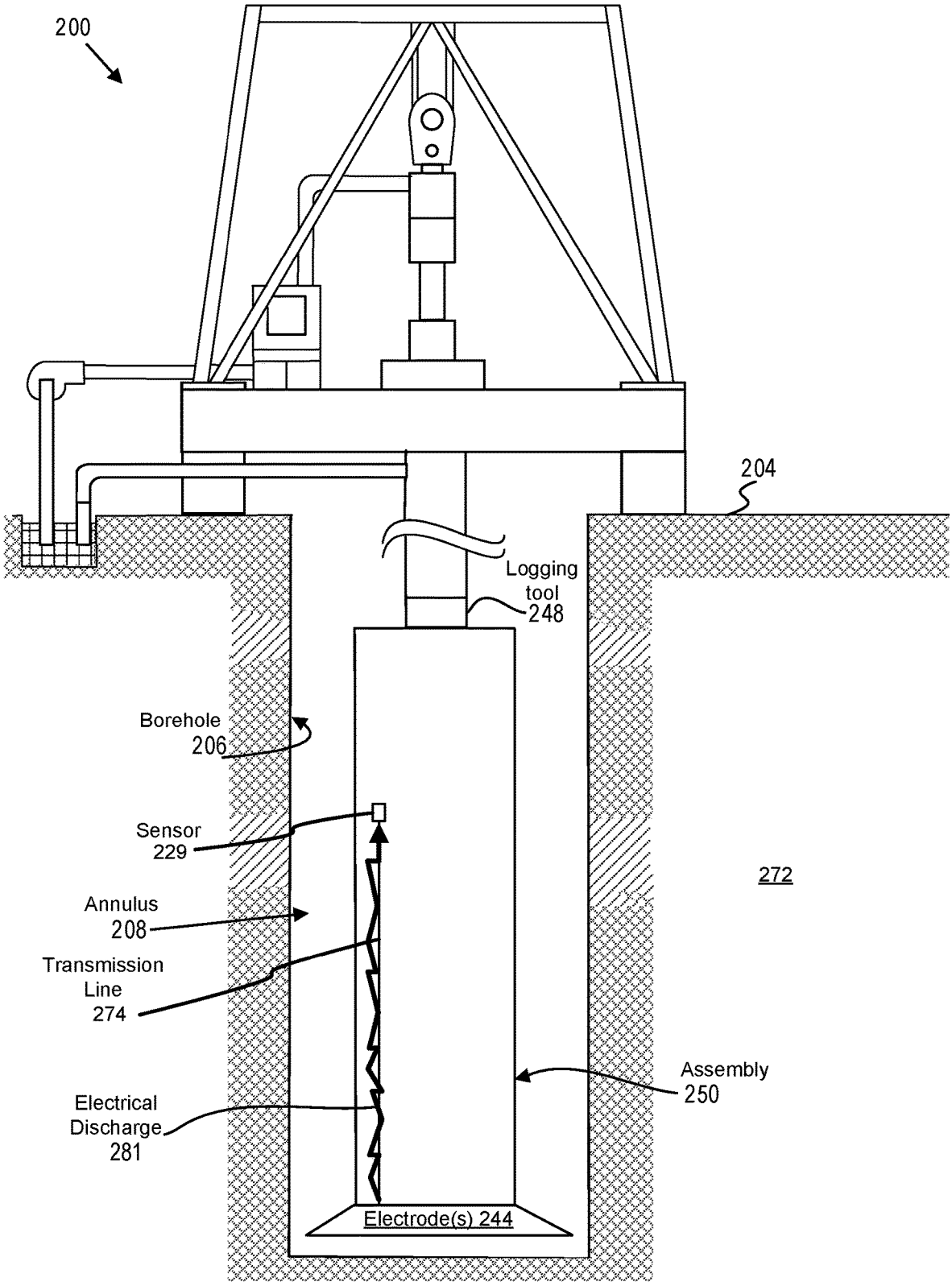
FIG. 2 depicts a second example pulse power drilling assembly that includes communications using electrical pulse power discharges, according to some embodiments.
Figure 3:
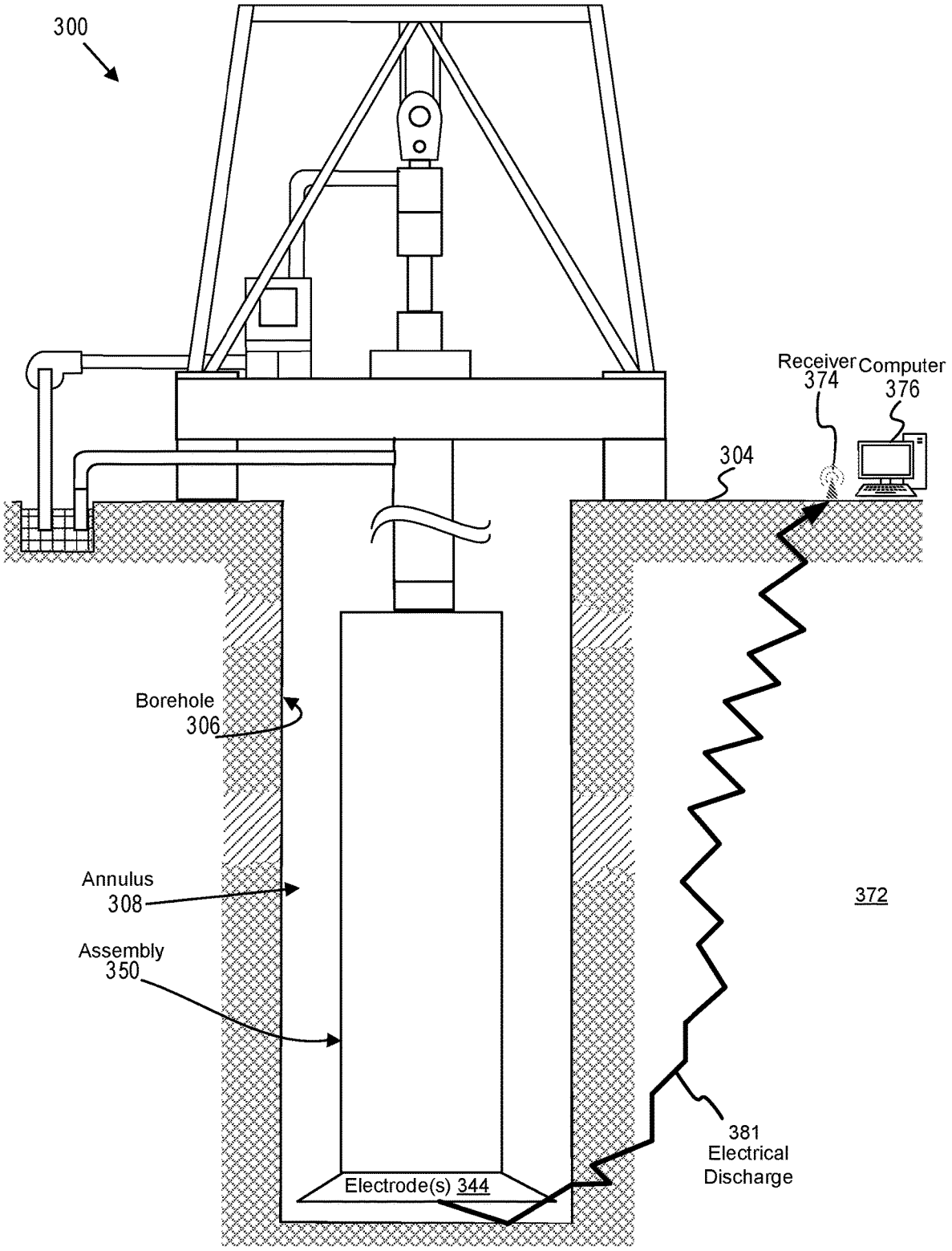
FIG. 3 depicts a third example pulse power drilling assembly that includes communications using electrical pulse power discharges, according to some embodiments.
Figure 4:
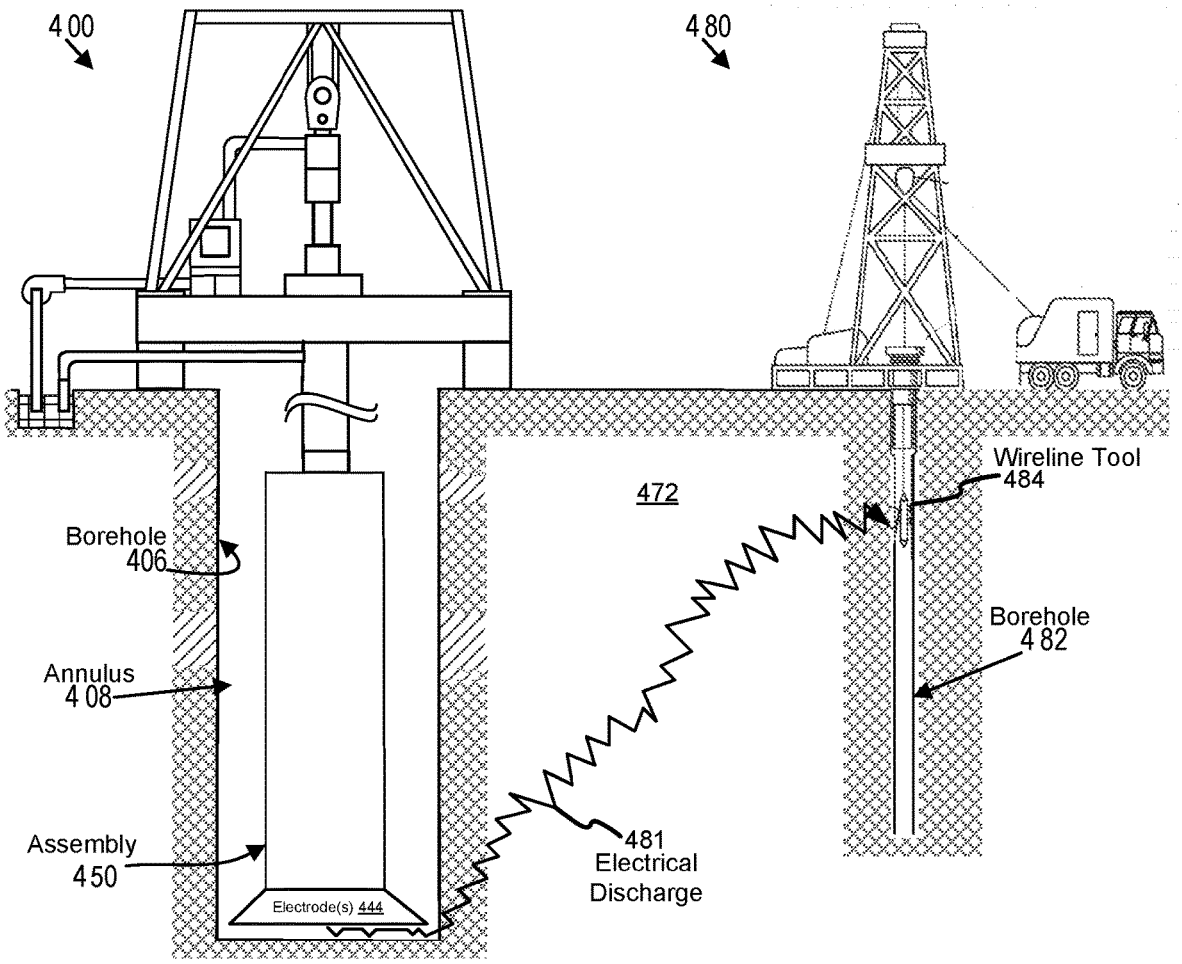
FIG. 4 depicts an example multi-borehole system that includes a pulse power drilling assembly and having communications using electrical pulse power discharges, according to some embodiments.

FIG. 1 depicts an example where the sensor to detect the electrical discharges is positioned on the assembly 150 and where the casing of the assembly 150 is the transmission medium over which the electrical discharge 181 propagates. However, the sensors can be positioned at other locations and/or the transmission medium over which the electrical discharge propagates can be different. FIGS. 2-4 depict some examples.

FIG. 2 depicts a second example pulse power drilling assembly that includes communications using electrical pulse power discharges, according to some embodiments. FIG. 2 illustrates an example pulse power drilling apparatus 200 that includes an example pulse power drilling assembly 250 (hereinafter "assembly"). Similar to the assembly 150 of FIG. 1, the sensor to detect the electrical discharges is positioned on the assembly 250. However, in contrast to the assembly 150 of FIG. 1, a physical transmission line within the assembly 250 is used for propagating the electrical discharge. The components and the configuration of the assembly 250 are similar to the assembly 150.

The assembly 250 can include one or more electrodes 244 for a pulse power drilling operation in a borehole 206 through a formation 272. The electrodes 244 can emit pulsed electrical discharges 281 to drill through the borehole 206. The pulsing can be modulated to encode a data communication in the electrical discharges 281. In some embodiments, the pulsing can be modulated to encode an acoustic data communication in an acoustic signal generated by the electrical discharges 281.

In some embodiments, the assembly 250 can include a transmission line 274 to transmit electrical data communications and/or acoustic data communications to a surface 204 of the borehole 206. The transmission line 274 can be electrically conductive and can propagate the electrical discharge 281 from the electrodes 244 uphole. For example, the transmission line 274 can propagate the pulsed electrical discharge 281 from the electrodes 244 to a sensor 229 located at the generator, where the electrical discharge 281 is detected. The transmission line 274 can be any kind of telemetry line capable of communicating data from the electrical discharge 281 uphole. For example, the transmission line 274 can be a fiber optic cable having an electrical transducer that can modulate a signal along the fiber optic cable in time based on the electrical discharge 281.

FIG. 3 depicts a third example pulse power drilling assembly that includes communications using electrical pulse power discharges, according to some embodiments. FIG. 3 illustrates an example pulse power drilling apparatus 300 that includes an example pulse power drilling assembly 350 (hereinafter "assembly"). Similar to the assembly 150 of FIG. 1, electrical discharges can be emitted from the electrodes. However, in contrast to the assembly 150 of FIG. 1, the formation is used for propagating the electrical discharge to a surface of the borehole where it is detected by a sensor. The components and the configuration of the assembly 350 are similar to the assembly 150.

The assembly 350 can include one or more electrodes 344 for a pulse power drilling operation in a borehole 306 through a formation 372. The electrodes 344 can emit pulsed electrical discharges 381 to drill through the borehole 306.

In some embodiments, the example pulse power drilling apparatus 300 can include a receiver 374 to detect the electrical discharges 381 as they propagate through the formation 372. For example, the electrical discharges 381 can travel through the formation 372 through conductive earth materials present in the formation 372 and be detected by the sensor 329. The electrical discharges 381 can be modulated to encode a data communication in the electrical discharges 381. A computer 376 can process a signal from the receiver 374 to decode and store or log the data communication embedded in the electrical discharges 381 as discharge parameters.

In some embodiments, the pulsing can be modulated to encode an acoustic data communication in an acoustic signal generated by the electrical discharges 381. The receiver 374 can include an acoustic sensor to receive the acoustic signal containing the encoded acoustic data communication. The acoustic signal can be generated by the electrical discharges 381 and can propagate through the formation 372. The computer 376 can process the signal to decode and store or log the acoustic data communication.

FIG. 4 depicts an example multi-borehole system that includes a pulse power drilling assembly having communications using electrical pulse power discharges, according to some embodiments. FIG. 4 illustrates an example pulse power drilling apparatus 400 that includes an example pulse power drilling assembly 450 (hereinafter "assembly"). Similar to the assembly 150 of FIG. 1, electrical discharges can be emitted from the electrodes. However, in contrast to the assembly 150 of FIG. 1, the formation is used for propagating the electrical discharge to a wireline tool in a neighboring borehole where it is detected by a sensor. The components and the configuration of the assembly 450 are similar to the assembly 150.

The assembly 450 can include one or more electrodes 444 for a pulse power drilling operation in a borehole 406 through a formation 472. The electrodes 444 can emit pulsed electrical discharges 481 to drill through the borehole 406.

An example wireline apparatus 480 can include a wireline tool 484 positioned in a borehole 482 neighboring the borehole 406. The wireline tool 484 can include a receiver or sensors to receive the electrical discharges 481 as they propagate through the formation 472. For example, the electrical discharges 481 can travel through the formation 472 through conductive earth materials present in the formation 472 and detected by a receiver of the wireline tool 484. The electrical discharges 481 can be modulated to encode a data communication in the electrical discharges 481. A computer can process the modulated electrical discharges to decode and store or log the data communication embedded in the electrical discharges 481 as discharge parameters.

In some embodiments, the pulsing can be modulated to encode an acoustic data communication in an acoustic signal generated by the electrical discharges 481. The wireline tool 484 can include an acoustic sensor to detect the acoustic signal containing the encoded acoustic data communication. The acoustic signal can be generated by the electrical discharges 481 and can propagate through the formation 472. A computer can process the signal to decode and store or log the acoustic data communication.

FIGS. 1-4 depict the electrical discharges either traversing up the drill string or out into the subsurface formation. In some embodiments, the electrical discharges could be traversing between the drill string and the subsurface formation. For example, the electrical discharges could be traversing within the annulus at some point. As an example, the drilling fluid can be conditioned to carry the electrical discharges. A detector and/or repeater can be positioned at any part of the drill string (not limited to the positions depicted in the FIGS. 1-2) to detect these electrical discharges. Also, in some embodiments, there can be any combination of electrical discharges depicted in FIGS. 1-4. For example, the pulsing can emit electrical discharges traversing the drill string, the annulus, and/or the subsurface formation. In such an example, one or more detectors at different positions in the current borehole, a neighboring borehole, and/or at the surface can detect the electrical discharges.

Example Operations

Figure 5:
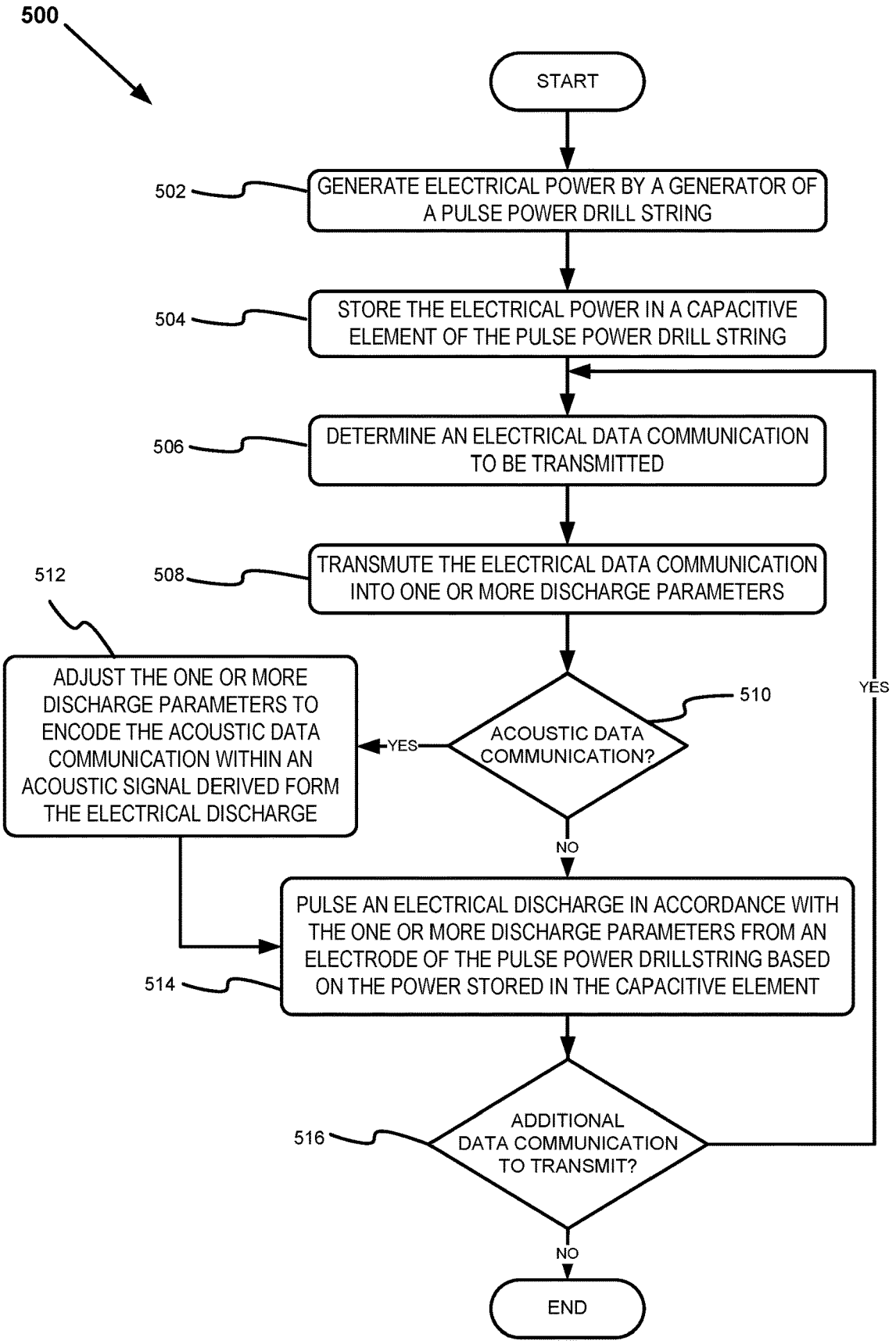
FIG. 5 depicts a flowchart of example operations for embedding and transmitting information in a modulated electrical discharge of a pulse power drilling operation, according to some embodiments.

FIG. 5 depicts a flowchart of example operations for embedding and transmitting information in a modulated electrical discharge of a pulse power drilling operation, according to some embodiments. Operations of a flowchart 500 of FIG. 5 can relate to modulating electrical discharges from a pulse power drilling assembly for data transmission. The flowchart 500 includes operations described as performed by a pulse power controller for consistency with the earlier description. Such operations can be performed by hardware, firmware, software, or a combination thereof. However, assembly component naming, division, sub-section organization, program code naming, organization, and deployment can vary due to arbitrary operator choice, assembly ordering, programmer choice, programming language(s), platform, etc. Additionally, operations of the flowchart 500 are described in reference to the example pulse power drilling apparatus 100 of FIG. 1. The flowchart 500 includes the operations of blocks 502 and 504 as performed by the generator 152 and the operations of blocks 506, 508, 512, and 514 as performed by the pulse power controller 130.

FIG. 5 includes operations that include transmuting data communications into discharge parameters. Operations also include electrically discharging, in accordance with the discharge parameters, capacitors or other electrical components whose electrical discharge is emitted out into a formation through electrodes. In some implementations, with reference to FIG. 1, the generator 152 and the pulse power controller 130 share a wired electrical connection or line that transfers voltage and current over a field joint (or any other type of joint or junction). The generator 152 charges the capacitors 136, 142 while the pulse power controller 130 controls the electrical discharge. By modulating characteristics of the electrical discharge, the pulse power controller 130 can embed a data communication in the electrical discharge for transmission. Operations of the flowchart 500 begin at block 502.

At block 502, electrical power is generated by a generator of a pulse power drill string. For example, with reference to FIG. 1, the generator 152 of the pulse power drilling assembly 150 can generate electrical power based on the flowing of the drilling fluid.

At block 504, the electrical power is stored in a capacitive element of a pulse power drill string. For example, with reference to FIG. 1, the electrical power generated by the generator 152 can be stored in the capacitors 136.

At block 506, an electrical data communication to be transmitted is determined. The electrical data communication can include information that is received from one or more sensors located in a borehole during a pulse power drilling operation. The information can include pressure data, flow data, temperature data, NMR data, ultrasonic data, formation characteristic data, etc. For example, with reference to FIG. 1, the pulse power controller 130 can receive sensor data from downhole sensors and determine that pressure data is to be included in an electrical data communication to be transmitted. Alternatively or in addition, the information can be instructions to modify the pulse power drilling operation. For example, the instructions can include a change in the charge rate, amount of charge, etc.

At block 508, the electrical data communication is transmuted into one or more discharge parameters. For example, with reference to FIG. 1, the pulse power controller 130 can transmute the electrical data communication into discharge parameters. For example, the pulse power controller 130 can transmute into a discharge parameter related to a time delay between electrical discharges. If the time delay is within a first range, the electrical data communication interpreted as one value; if the time delay is within a second range, the electrical data communication is interpreted as a second value. In some embodiments, data from multiple types of sensors can be transmuted into distinct discharge parameters that can be layered to transmit multiple types of information in a single discharge or a series of discharges. For example, in addition to transmuting a first data communication into a time delay between discharges, a second data communication can be transmuted into an amplitude for the discharges.

At block 510, a determination is made whether there is an acoustic data communication to be transmitted. In particular, in some embodiments, in addition to an electrical data communication, there can be an acoustic-based data transmission that is related to the electrical discharge. If there is an acoustic data communication to be transmitted, flow continues at block 512. If there is not an acoustic data communication to be transmitted, flow continues at block 514.

At block 512, the one or more discharge parameters are adjusted to encode the acoustic data communication within an acoustic signal derived from the electrical discharge. An acoustic data communication can be encoded in the generated acoustic signal by modulating pulsing of the electrical discharge. The one or more discharge parameters for the electrical data communication can be adjusted to encode the acoustic data communication in the generated acoustic signal derived from the electrical discharge. For example, a frequency of the electrical discharge can be a discharge parameter for an electrical data communication having encoded sensor data. An acoustic data communication can be encoded by adjusting the frequency of the electrical discharge. Encoding sensor data in both an electrical data communication and an acoustic data communication can provide redundancy of data and/or improve a signal-to-noise ratio. In some implementations, the frequency can be selected based on a resonant frequency or a frequency resulting in a high signal-to-noise ratio based on characteristics of the surrounding formation and/or characteristics of the drill string to improve data communication.

At block 514, an electrical discharge is pulsed in accordance with the one or more discharge parameters based on the power stored in the capacitive element. For example, with reference to FIG. 1, the electrical discharge 181 can be emitted from the electrode 144 of the assembly 150 using the power stored in the primary capacitors 136.

In some embodiments, the electrical discharge can be emitted while drilling. For example, electrical discharges through the rock of the subsurface formation breaking the rock can also be modulated to transmit data communications as the drilling operation occurs. The discharge parameters can be adjusted within a tolerance level to preserve drilling efficiency. For example, a time delay between discharges can be a discharge parameter and the time delay can be a duration that does not significantly impact drilling speed. In some embodiments, there can be a slight slowdown in drilling speed to increase a rate of data communication. For example, if there is a low signal-to-noise ratio at short time delays between sequential discharges, it may be beneficial to increase the time delay between discharges, and in turn decrease the drilling speed, to increase the signal-to-noise ratio and improve data communication. In some embodiments, an acoustic signal can be generated by the blasting of rock caused by the electrical discharge. For example, acoustic noise from blasting formation rock as part of a drilling operation can be used to transmit data communications. Alternatively or in addition, the electrical discharge can induce a detectable change in a borehole fluid. For example, emission of the electrical discharge can cause a detectable thermodynamic expansion of a borehole fluid. The thermodynamic expansion can be detected as a change in pressure and can be used as a means to transmit data communications.

In some implementations, the electrical discharge can be transmitted along a wired telemetry system. For example, with reference to FIG. 2, the electrical discharge 281 can be transmitted along the transmission line 274. The electrical discharge 281 can be transmitted such that it does not interfere with other data transmission occurring along the transmission line 274. For example, the electrical discharge 281 can be transmitted using a time-division multiple access or code-division multiple access method.

In some implementations, the electrical discharge can propagate through a formation. For example, with reference to FIG. 3, the electrical discharge 381 can excite certain elements present in the formation 372 and can be detected at the surface by the receiver 374. In some embodiments, the electrical discharge and/or an acoustic signal can propagate through a formation to be detected by a wireline tool in a neighboring borehole. For example, with reference to FIG. 4, the electrical discharge 481 and/or the acoustic signal can propagate through the formation 472 to be detected by a sensor of the wireline tool 484 in the neighboring borehole 482.

In some implementations, it can be beneficial to stop a drilling operation to transmit data. The electrical discharge can be emitted while the drill string is in a stopped position and the electrode can be dedicated exclusively to discharging for data communication purposes. For example, with reference to FIG. 1, the electrode 144 of the tool body 146 can emit the electrical discharge 181 in a stopped position where the electrode 144 is a distance from a bottom of the borehole 106 such that the electrical discharge 181 does not extend the borehole 106 further through the formation 172. In some embodiments, the borehole can be flooded with a specially designed fluid to increase the data communication rate and/or increase the signal-to-noise ratio. The fluid can be designed to carry the electrical discharge and/or the acoustic signal. For example, with reference to FIG. 1, the annulus 108 can be flooded with a water-based drilling mud and the electrical discharge can be detected at the logging tool 148 using resistivity measurements. As a second example, a drilling dielectric fluid that is designed to have a compressibility that can enable propagation of an acoustic signal through the dielectric fluid can be used to flood the annulus 108 to allow for transmittance of the acoustic signal.

At block 516, a determination is made whether there is an additional data communication to transmitted. If there is an additional data communication to transmit, flow continues at block 506 to determine an electrical data communication to be transmitted. Otherwise, operations of the flowchart 500 are complete.

Figure 6:
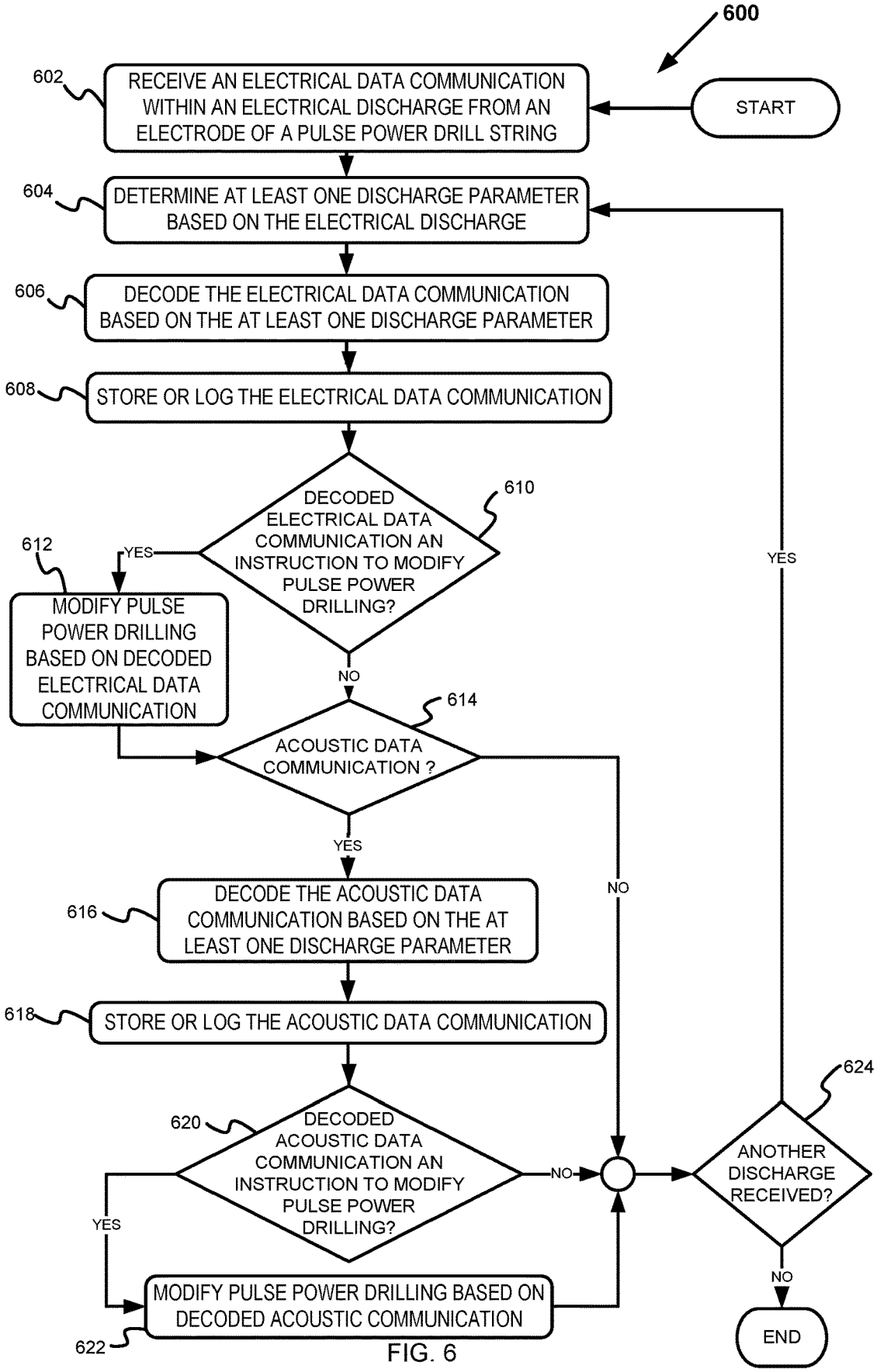
FIG. 6 depicts a flowchart of example operations for receiving and decoding information embedded in a modulated electrical discharge of a pulse power drilling operation, according to some embodiments.

FIG. 6 depicts a flowchart of example operations for receiving and decoding information embedded in a modulated electrical discharge of a pulse power drilling operation, according to some embodiments. Operations of a flowchart 600 of FIG. 6 can include receiving a data communication from downhole through a modulated electrical discharge from one or more electrodes of a pulse power drill string. The flowchart 600 includes operations described as performed by a sensor and a computer for consistency with the earlier description. Such operations can be performed by hardware, firmware, software, or a combination thereof. However, assembly component naming, division, sub-section organization, program code naming, organization, and deployment can vary due to arbitrary operator choice, assembly ordering, programmer choice, programming language(s), platform, etc. Additionally, operations of the flowchart 600 are described in reference to the example pulse power drilling apparatus 100 of FIG. 1.

At block 602, an electrical data communication within an electrical discharge is received from an electrode of a pulse power drill string. A sensor located on the drill string uphole of the electrode can receive the discharge. For example, with reference to FIG. 1, the sensor 129 can receive the electrical data communication encoded in the electrical discharge 181.

In some embodiments, a sensor can be located at a surface of a borehole. For example, with reference to FIG. 3, the receiver 374 can include an electrical sensor to detect the electrical discharge 381. Alternatively or in addition, the receiver 374 can include an acoustic sensor to detect an acoustic signal derived from the electrical discharge 381.

In some embodiments, a sensor can be located in a neighboring borehole. For example, with reference to FIG. 4, a sensor (electrical and/or acoustic) of the wireline tool 448 can detect the electrical discharge 481 that has propagated through the formation 472.

At block 604, at least one discharge parameter is determined based on the electrical discharge. A computer can process a signal detected by a sensor to determine the discharge parameters. For example, with reference to FIG. 3, the electrical discharge 381 can be discharged in accordance with discharge parameters including a defined discharge frequency to be detected by a sensor of the receiver 374, and the computer 376 can process the signal to determine that a discharge parameter of the electrical signal has a defined frequency value.

At block 606, the electrical data communication is decoded based on the at least one discharge parameter. In some embodiments, the discharge parameters can represent binary code. The electrical data communication can be decoded from the electrical discharge by determining the discharge parameters. For example, the data communication can be derived from a series of ones and zeros represented by the series of time delays between discharges. With reference to FIG. 1, electrical discharges from the electrode 144 can be modulated such that a 1 second delay between sequential electrical discharges represents a zero and a 2 second delay between sequential electrical discharges represents a one. While described in terms of embedding information as binary code, information can be embedded in electrical discharges and/or acoustic signals using any wireless communication scheme known to those in the art that can be implemented as practiced with conventional telemetry systems.

At block 608, the electrical data communication is stored or logged. For example, the electrical data communication can be stored in a machine-readable medium that is part of the computer decoding the data communication.

At block 610, a determination is made whether the decoded electrical data communication is an instruction to modify a pulse power drilling operation. If the decoded electrical data communication is an instruction to modify a pulse power drilling operation, flow continues at block 612. If the decoded electrical data communication is not an instruction to modify a pulse power drilling operation, flow continues at block 614.

At block 612, a pulse power drilling operation is modified based on the decoded electrical data communication. For example, with reference to FIG. 1, the sensor 129 can receive the electrical discharge 181 containing an electrical data communication that is an instruction to adjust a charge time of the primary capacitors 136 and the generator controller 128 can increase or decrease the charge time according to the instructions of the electrical data communication.

At block 614, a determination is made whether an acoustic data communication is received. For example, with reference to FIG. 3, the receiver 374 can receive an acoustic data communication via an acoustic signal propagated through the formation 372. If an acoustic data communication was received, flow continues at block 616. If an acoustic data communication was not received, flow continues at block 624.

At block 616, the acoustic data communication is decoded based on the at least one discharge parameter. For example, an acoustic data communication can be derived from a series of ones and zeros represented by a series of time delays between discharges. With reference to FIG. 1, electrical discharges from the electrode 144 can be modulated such that a time delay between electrical discharges results in a modulated acoustic signal. For example, a 1 second delay between sequential electrical discharges can represent a zero and a 2 second delay between sequential electrical discharges can represent a one, and the acoustic signal generated by this discharge pattern can be decoded based on the electrical discharge parameter of a time delay between discharges.

At block 618, the acoustic data communication is stored or logged. The acoustic data communication can be stored in a machine-readable medium that is part of the computer decoding the data communication.

At block 620, a determination is made whether the decoded acoustic data communication is an instruction to modify a pulse power drilling operation. If the decoded acoustic data communication is an instruction to modify a pulse power drilling operation, flow continues at block 622. If the decoded acoustic data communication is not an instruction to modify a pulse power drilling operation, flow continues at block 624.

At block 622, a pulse power drilling operation is modified based on the decoded acoustic data communication. For example, with reference to FIG. 3, the receiver 374 can receive an acoustic signal generated by the electrical discharge 381 that contains an acoustic data communication that is an instruction to adjust a level of power generated by the generator, and the generator controller 128 can increase or decrease the power generated according to the instructions of the acoustic data communication.

At block 624, a determination is made whether another electrical discharge is received. If another electrical discharge is received, flow continues at block 604 and at least one discharge parameter is again determined based on the received electrical discharge. If another electrical discharge is not received, operations of the flowchart 600 are complete.

FIGS. 5 and 6 are annotated with a series of numbers. These numbers represent stages of operations. Although these stages are ordered for this example, the stages illustrate one example to aid in understanding this disclosure and should not be used to limit the claims. Subject matter falling within the scope of the claims can vary with respect to the order and some of the operations.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 504 and 506 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

Example Computer

Figure 7:
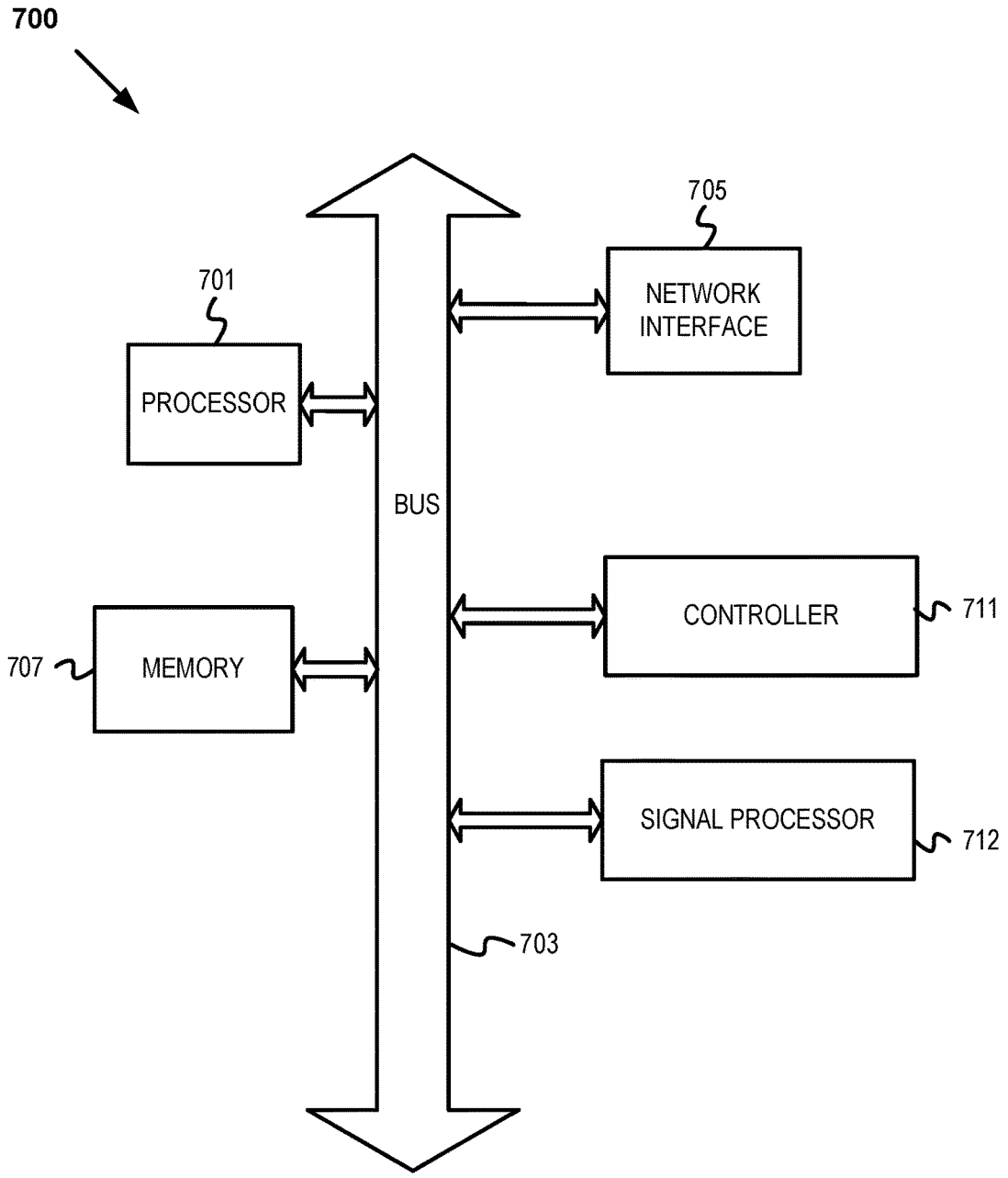
FIG. 7 depicts an example computer, according to some embodiments.

FIG. 7 depicts an example computer, according to some embodiments. A computer 700 of FIG. 7 can be representative of a computer or controller in the generator 152 or the pulse power section 154 of FIG. 1. For example, the computer 700 can be an example computer in the pulse power section 154 to control the discharge parameters of the electrical discharge (as described above). The computer 700 can also an example computer used to receive and decode the communication in electrical discharges (as described above). For example, the computer 700 can be an example computer positioned downhole and/or at a surface to receive data from a sensor that detects an electrical discharge and to decode the data to determine the communication in the electrical discharge.

The computer 700 includes a processor 701 (possibly including multiple processors, multiple cores, multiple nodes, and/or implementing multi-threading, etc.). The computer 700 includes a memory 707. The memory 707 may be system memory or any one or more of the above already described possible realizations of machine-readable media. The computer 700 also includes a bus 703 and a network interface 705.

The computer 700 also includes a controller 711 and a signal processor 712. The controller 711 and the signal processor 712 can be hardware, software, firmware, or a combination thereof. For example, the controller 711 and the signal processor 712 can be software executing on the processor 701. Any one of the previously described functionalities may be partially (or entirely) implemented in hardware and/or on the processor 701. For example, the functionality may be implemented with an application specific integrated circuit, in logic implemented in the processor 701, in a co-processor on a peripheral device or card, etc. Further, realizations may include fewer or additional components not illustrated in FIG. 7 (e.g., video cards, audio cards, additional network interfaces, peripheral devices, etc.). The processor 701 and the network interface 705 are coupled to the bus 703. Although illustrated as being coupled to the bus 703, the memory 707 may be coupled to the processor 701.

While the aspects of the disclosure are described with reference to various implementations and exploitations, it will be understood that these aspects are illustrative and that the scope of the claims is not limited to them. In general, techniques for telemetry using modulating pulse power drilling systems as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Embodiment 1: A system comprising a pulse power drill string to be positioned in a borehole formed in a subsurface formation, the pulse power drill string to drill the borehole based on periodic pulsing of an electrical discharge into the subsurface formation, the pulse power drill string comprising a generator to generate electrical power; an electrode to emit the electrical discharge out to the subsurface formation based on the electrical power; and a controller communicatively coupled to the generator and the electrode, the controller to control at least one discharge parameter of the electrical discharge to encode a data communication within the electrical discharge.

Embodiment 2: The system of Embodiment 1, further comprising a receiver configured to receive the data communication within the electrical discharge, wherein the receiver is located at at least one of a surface of the borehole, a device positioned in a different borehole, and a location on the pulse power drill string closer to the surface of the borehole than the electrode; a computer device comprising, a processor; and a machine-readable medium having program code executable by the processor to cause the processor to decode the data communication based on the at least one discharge parameter.

Embodiment 3: The system of Embodiment 1, further comprising a receiver positioned on the pulse power drill string closer to the surface of the borehole than the electrode, the receiver configured to receive the data communication within the electrical discharge; a computer device comprising, a processor; and a machine-readable medium having program code executable by the processor to cause the processor to decode the data communication based on the at least one discharge parameter.

Embodiment 4: The system of any one of Embodiments 1-3, further comprising a drilling fluid to flow down the pulse power drill string and return to a surface of the borehole via an annulus that is between the pulse power drill string and a wall of the borehole, wherein the drilling fluid comprises a data carrying fluid configured to carry the data communication within the electrical discharge.

Embodiment 5: The system of any one of Embodiments 1-4, wherein a casing of the pulse power drill string is a transmission medium over which the data communication is to propagate.

Embodiment 6: The system of any one of Embodiments 1-4, wherein the subsurface formation is a transmission medium through which the data communication is to propagate.

Embodiment 7: The system of any one of Embodiments 1-4, wherein an electrical conductor positioned along the pulse power drill string is a transmission medium through which the data communication is to propagate.

Embodiment 8: The system of Embodiment 7, wherein the data communication is to propagate along the electrical conductor in accordance with a shared multiple access protocol.

Embodiment 9: The system of any one of Embodiments 1-8, wherein the controller to control at least one discharge parameter of the electrical discharge to encode the data communication within the electrical discharge comprises the controller to adjust at least one of a frequency of the electrical discharge, a timing of the pulsing of the electrical discharge, a phase of the electrical discharge, and an amplitude of the electrical discharge.

Embodiment 10: The system of any one of Embodiments 1-9, wherein an acoustic signal is generated as part of the electrical discharge, wherein the controller is to control the at least one discharge parameter of the electrical discharge to encode an acoustic data communication within the acoustic signal.

Embodiment 11: The system of Embodiment 10, wherein the controller to control at least one discharge parameter of the electrical discharge to encode the acoustic data communication within the acoustic signal comprises the controller to adjust at least one of a frequency of the electrical discharge, a timing of the pulsing of the electrical discharge, a phase of the electrical discharge, and an amplitude of the electrical discharge.

Embodiment 12: A method comprising performing a pulse power drilling operation, with a pulse power drill string positioned in a borehole formed in a subsurface formation, based on a periodic pulsing of an electrical discharge into the subsurface formation, wherein performing the pulse power drilling operation comprises generating electrical power by a generator of the pulse power drill string; storing the electrical power in a capacitive element of the pulse power drill string; determining a data communication to be transmitted; transmuting the data communication into at least one discharge parameter; and pulsing the electrical discharge from an electrode of the pulse power drill string based on the electrical power stored in the capacitive element and in accordance with the one or more discharge parameters to encode the data communication in the electrical discharge.

Embodiment 13: The method of Embodiment 12, further comprising receiving the data communication within the electrical discharge at a location that comprises at least one of a surface of the borehole, a device positioned in a different borehole, and a location on the pulse power drill string closer to the surface of the borehole than the electrode; and decoding the data communication based on the at least one discharge parameter.

Embodiment 14: The method of Embodiments 12 or 13, wherein the subsurface formation is a transmission medium through which the data communication is to propagate.

Embodiment 15: The method of Embodiments 12 or 13, further comprising receiving, at a location on the pulse power drill string closer to the surface of the borehole than the electrode, the data communication within the electrical discharge; decoding the data communication based on the at least one discharge parameter; and modifying at least one generator parameter of the generator based on the decoded data communication.

Embodiment 16: The method of Embodiment 15, wherein a casing of the pulse power drill string is a transmission medium over which the data communication is to propagate.

Embodiment 17: The method of any one of Embodiments 12-16, wherein transmuting the data communication into the at least one discharge parameter comprises adjusting at least one of a frequency of the electrical discharge, a timing of the pulsing of the electrical discharge, a phase of the electrical discharge, and an amplitude of the electrical discharge.

Embodiment 18: One or more non-transitory machine-readable media comprising program code executable by a processor to cause the processor to determine a data communication that needs to be transmitted during a pulse power drilling operation with a pulse power drill string positioned in a borehole formed in a subsurface formation, based on a periodic pulsing of an electrical discharge into the subsurface formation; transmute the data communication into at least one discharge parameter; and pulse the electrical discharge from an electrode of the pulse power drill string in accordance with the at least one discharge parameter to encode the data communication in the electrical discharge.

Embodiment 19: The one or more non-transitory machine-readable media of Embodiment 18, wherein the program code executable by the processor to cause the processor to transmute the data communication into the at least one discharge parameter comprises program code executable by the processor to cause the processor to adjust at least one of a frequency of the electrical discharge, a timing of the pulsing of the electrical discharge, a phase of the electrical discharge, and an amplitude of the electrical discharge.

Embodiment 20: The one or more non-transitory machine-readable media of Embodiments 18 or 19, wherein the data communication within the electrical discharge is to be received at a location that comprises at least one of a surface of the borehole, a device positioned in a different borehole, and a location on the pulse power drill string closer to the surface of the borehole than the electrode, and wherein the data communication is to be decoded based on the at least one discharge parameter.

What is claimed is:

1. A system comprising:

a pulse power drill string to be positioned in a borehole formed in a subsurface formation, the pulse power drill string to drill the borehole based on periodic pulsing of an electrical discharge into the subsurface formation, the pulse power drill string comprising, a generator to generate electrical power;

an electrode to emit the electrical discharge out to the subsurface formation based on the electrical power; and a controller communicatively coupled to the generator and the electrode, the controller to control at least one discharge parameter of the electrical discharge to encode a data communication within the same electrical discharge used to drill the borehole.

2. The system of claim 1, further comprising:

a drilling fluid to flow down the pulse power drill string and return to a surface of the borehole via an annulus that is between the pulse power drill string and a wall of the borehole, wherein the drilling fluid comprises a data carrying fluid configured to carry the data communication within the electrical discharge.

3. The system of claim 1, wherein a casing of the pulse power drill string is a transmission medium over which the data communication is to propagate.

4. The system of claim 1, wherein the subsurface formation is a transmission medium through which the data communication is to propagate.

5. The system of claim 1, wherein an electrical conductor positioned along the pulse power drill string is a transmission medium through which the data communication is to propagate.

6. The system of claim 5, wherein the data communication is to propagate along the electrical conductor in accordance with a shared multiple access protocol.

7. The system of claim 1, wherein the controller to control the at least one discharge parameter of the electrical discharge to encode the data communication within the electrical discharge comprises the controller to adjust at least one of a frequency of the electrical discharge, a timing of the pulsing of the electrical discharge, a phase of the electrical discharge, and an amplitude of the electrical discharge.

8. The system of claim 1, further comprising:

a receiver configured to receive the data communication within the electrical discharge, wherein the receiver is located at least one of a surface of the borehole, a device positioned in a different borehole, and a location on the pulse power drill string closer to the surface of the borehole than the electrode;

a computer device comprising, a processor; and a machine-readable medium having program code executable by the processor to cause the processor to decode the data communication based on the at least one discharge parameter.

9. The system of claim 1, further comprising:

a receiver positioned on the pulse power drill string closer to a surface of the borehole than the electrode, the receiver configured to receive the data communication within the electrical discharge;

a computer device comprising, a processor; and a machine-readable medium having program code executable by the processor to cause the processor to, decode the data communication based on the at least one discharge parameter; and modify at least one generator parameter of the generator based on the decoded data communication.

10. The system of claim 1, wherein an acoustic signal is generated as part of the electrical discharge, wherein the controller is to control the at least one discharge parameter of the electrical discharge to encode an acoustic data communication within the acoustic signal.

11. The system of claim 10, wherein the controller to control the at least one discharge parameter of the electrical discharge to encode the acoustic data communication within the acoustic signal comprises the controller to adjust at least one of a frequency of the electrical discharge, a timing of the pulsing of the electrical discharge, a phase of the electrical discharge, and an amplitude of the electrical discharge.

12. A method comprising:

performing a pulse power drilling operation, with a pulse power drill string positioned in a borehole formed in a subsurface formation, based on a periodic pulsing of an electrical discharge into the subsurface formation, wherein performing the pulse power drilling operation comprises, generating electrical power by a generator of the pulse power drill string;

storing the electrical power in a capacitive element of the pulse power drill string;

determining a data communication to be transmitted;

transmuting the data communication into at least one discharge parameter; and pulsing the electrical discharge from an electrode of the pulse power drill string based on the electrical power stored in the capacitive element and in accordance with the one or more discharge parameters to encode the data communication in the electrical discharge.

13. The method of claim 12, wherein transmuting the data communication into the at least one discharge parameter comprises adjusting at least one of a frequency of the electrical discharge, a timing of the pulsing of the electrical discharge, a phase of the electrical discharge, and an amplitude of the electrical discharge.

14. The method of claim 12, further comprising:

receiving the data communication within the electrical discharge at a location that comprises at least one of a surface of the borehole, a device positioned in a different borehole, and a location on the pulse power drill string closer to the surface of the borehole than the electrode; and decoding the data communication based on the at least one discharge parameter.

15. The method of claim 12, further comprising:

receiving, at a location on the pulse power drill string closer to a surface of the borehole than the electrode, the data communication within the electrical discharge;

decoding the data communication based on the at least one discharge parameter; and modifying at least one generator parameter of the generator based on the decoded data communication.

16. The method of claim 12, wherein a casing of the pulse power drill string is a transmission medium over which the data communication is to propagate.

17. The method of claim 12, wherein the subsurface formation is a transmission medium through which the data communication is to propagate.

18. One or more non-transitory machine-readable media comprising program code executable by a processor to cause the processor to:

determine a data communication to be transmitted during a pulse power drilling operation with a pulse power drill string positioned in a borehole formed in a subsurface formation, based on a periodic pulsing of an electrical discharge into the subsurface formation;

transmute the data communication into at least one discharge parameter; and pulse the electrical discharge from an electrode of the pulse power drill string in accordance with the at least one discharge parameter to encode the data communication in the electrical discharge, wherein the data communication is encoded in the electrical discharge used to drill the borehole.

19. The one or more non-transitory machine-readable media of claim 18, wherein the program code executable by the processor to cause the processor to transmute the data communication into the at least one discharge parameter comprises program code executable by the processor to cause the processor to adjust at least one of a frequency of the electrical discharge, a timing of the pulsing of the electrical discharge, a phase of the electrical discharge, and an amplitude of the electrical discharge.

20. The one or more non-transitory machine-readable media of claim 18, wherein the data communication within the electrical discharge is to be received at a location that comprises at least one of a surface of the borehole, a device positioned in a different borehole, and a location on the pulse power drill string closer to the surface of the borehole than the electrode, and wherein the data communication is to be decoded based on the at least one discharge parameter.

* * * * *